US011591682B2

(12) United States Patent
Lee et al.

(10) Patent No.: US 11,591,682 B2
(45) Date of Patent: Feb. 28, 2023

(54) CU—CO—SI—FE—P-BASED ALLOY WITH EXCELLENT BENDING FORMABILITY AND PRODUCTION METHOD THEREOF

(71) Applicant: POONGSAN CORPORATION, Pyeongtaek-Si (KR)

(72) Inventors: Sidam Lee, Ulsan (KR); Wonshin Kwak, Ulsan (KR); Wonseok Jeong, Ulsan (KR)

(73) Assignee: POONGSAN CORPORATION, Gyeonggi-do (KR)

( * ) Notice: Subject to any disclaimer, the term of this patent is extended or adjusted under 35 U.S.C. 154(b) by 50 days.

(21) Appl. No.: 16/954,904

(22) PCT Filed: Jan. 20, 2020

(86) PCT No.: PCT/KR2020/000941

§ 371 (c)(1),
(2) Date: Jun. 17, 2020

(87) PCT Pub. No.: WO2020/209485

PCT Pub. Date: Oct. 15, 2020

(65) Prior Publication Data

US 2021/0230727 A1 Jul. 29, 2021

(30) Foreign Application Priority Data

Apr. 9, 2019 (KR) ..... 10-2019-0041379

(51) Int. Cl.
*C22F 1/08* (2006.01)
*B21B 3/00* (2006.01)
(Continued)

(52) U.S. Cl.
CPC ..... *C22F 1/08* (2013.01); *B21B 3/00* (2013.01); *C22C 1/02* (2013.01); *C22C 9/06* (2013.01); *B21B 2003/005* (2013.01)

(58) Field of Classification Search
CPC ..... C22F 1/08; B21B 3/00; B21B 2003/005; B21B 37/48; C22C 1/02; C22C 9/06; C22B 15/0028
See application file for complete search history.

(56) References Cited

U.S. PATENT DOCUMENTS

2008/0056930 A1* 3/2008 Ito ..... C22C 9/06 420/477
2013/0019997 A1* 1/2013 Okafuji ..... H01B 1/026 148/411

(Continued)

FOREIGN PATENT DOCUMENTS

CN 101522927 A * 9/2009 ..... C22C 9/06
CN 101522927 A 9/2009

(Continued)

OTHER PUBLICATIONS

First Office Action for Chinese Patent Application No. 202080000801.1 dated Jun. 10, 2021, 16 pages.

(Continued)

*Primary Examiner* — John A Hevey
(74) *Attorney, Agent, or Firm* — Loeb & Loeb LLP

(57) ABSTRACT

Disclosed are a copper-cobalt-silicon-iron-phosphorus (Cu—Co—Si—Fe—P)-based alloy having strength, electrical conductivity, and excellent bending formability, and a method for producing the alloy. The copper alloy contains 1.2 to 2.5% by mass of cobalt (Co); 0.2 to 1.0% by mass of silicon (Si); 0.01 to 0.5% by mass of iron (Fe); 0.001 to 0.2% by mass of phosphorus (P); a balance amount of copper (Cu); unavoidable impurities; and optionally, 0.05% by mass or smaller of each of at least one selected from a group consisting of nickel (Ni), manganese (Mn) and magnesium (Mg), wherein a ratio between cobalt (Co) mass and silicon (Si) mass meets a relationship: 3.5≤Co/Si≤4.5, wherein a ratio between iron (Fe) mass and phosphorus (P) mass meets (Continued)

a relationship: 1.0<Fe/P. A bimodal structure improves the bending formability while maintaining the electrical conductivity and strength.

3 Claims, 4 Drawing Sheets

(51) Int. Cl.
*C22C 1/02* (2006.01)
*C22C 9/06* (2006.01)

(56) References Cited

U.S. PATENT DOCUMENTS

| | | | |
|---|---|---|---|
| 2013/0098511 | A1 | 4/2013 | Onda |
| 2014/0014241 | A1 | 1/2014 | Kuwagaki et al. |

FOREIGN PATENT DOCUMENTS

| | | | |
|---|---|---|---|
| CN | 101939460 | A | 1/2011 |
| CN | 102099499 | A | 6/2011 |
| CN | 102812138 | A | 12/2012 |
| JP | 2008056977 | A | 3/2008 |
| JP | 2010236029 | A | 10/2010 |
| JP | 2011246740 | A | 12/2011 |
| JP | 2012201977 | A | 10/2012 |
| JP | 2013104078 | A | 5/2013 |
| JP | 2014205864 | A | 10/2014 |
| KR | 1020120137507 | A | 12/2012 |

OTHER PUBLICATIONS

Office Action for corresponding Japanese Application No. 2020-528030, dated Aug. 27, 2021, 10 pages.

* cited by examiner

【FIG. 1】
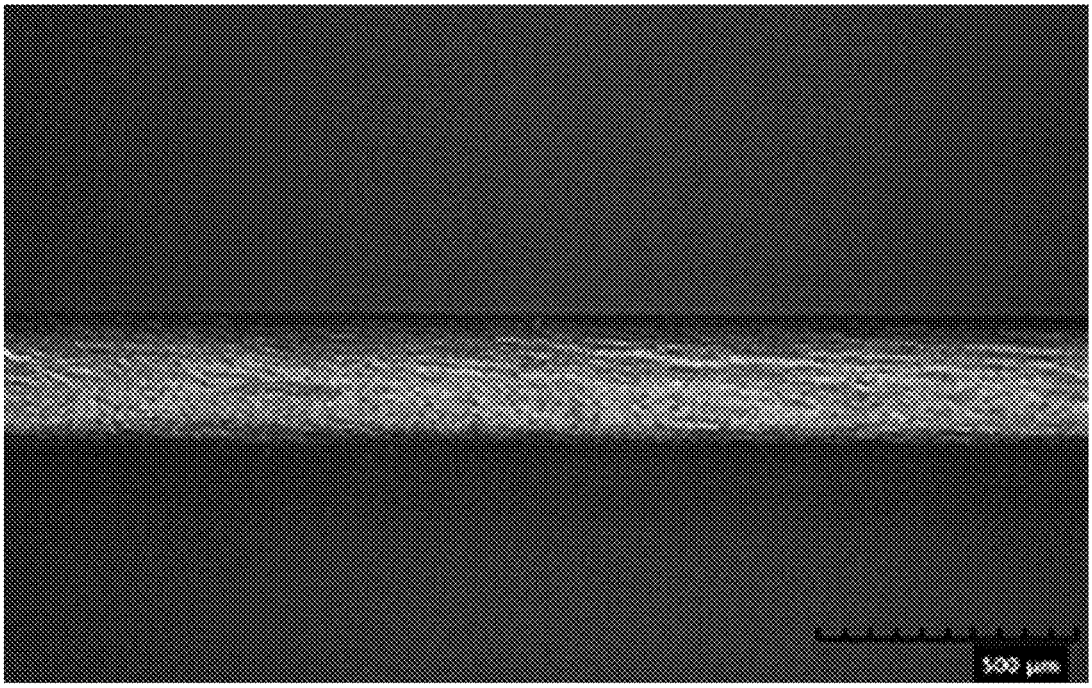

【FIG. 2】
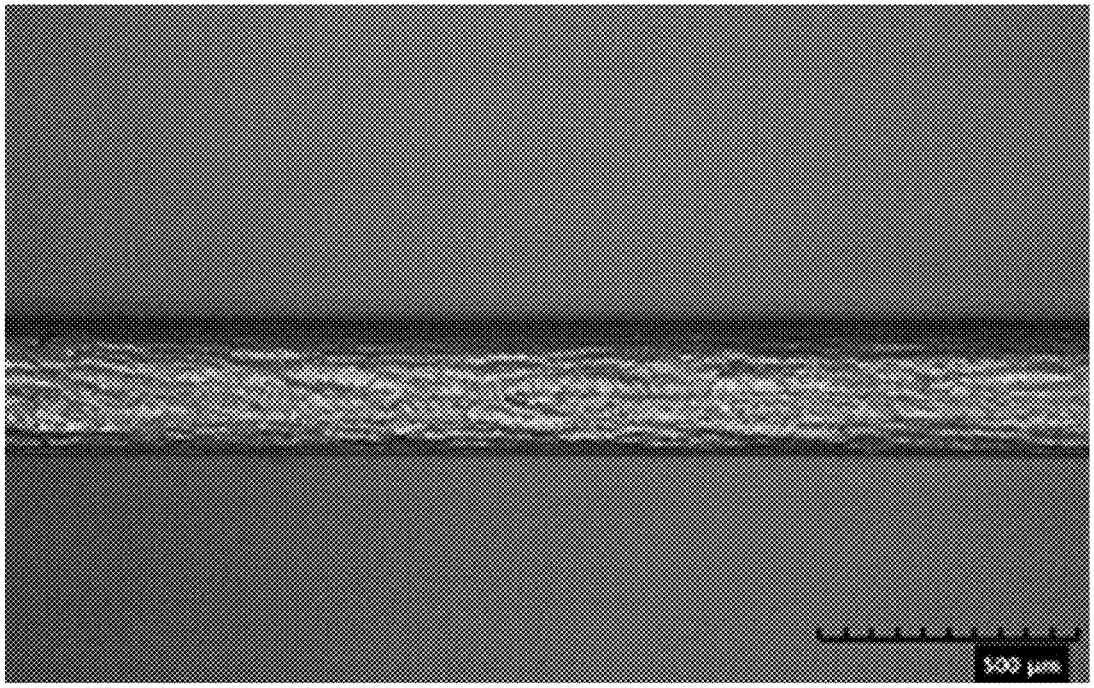

[FIG. 3]
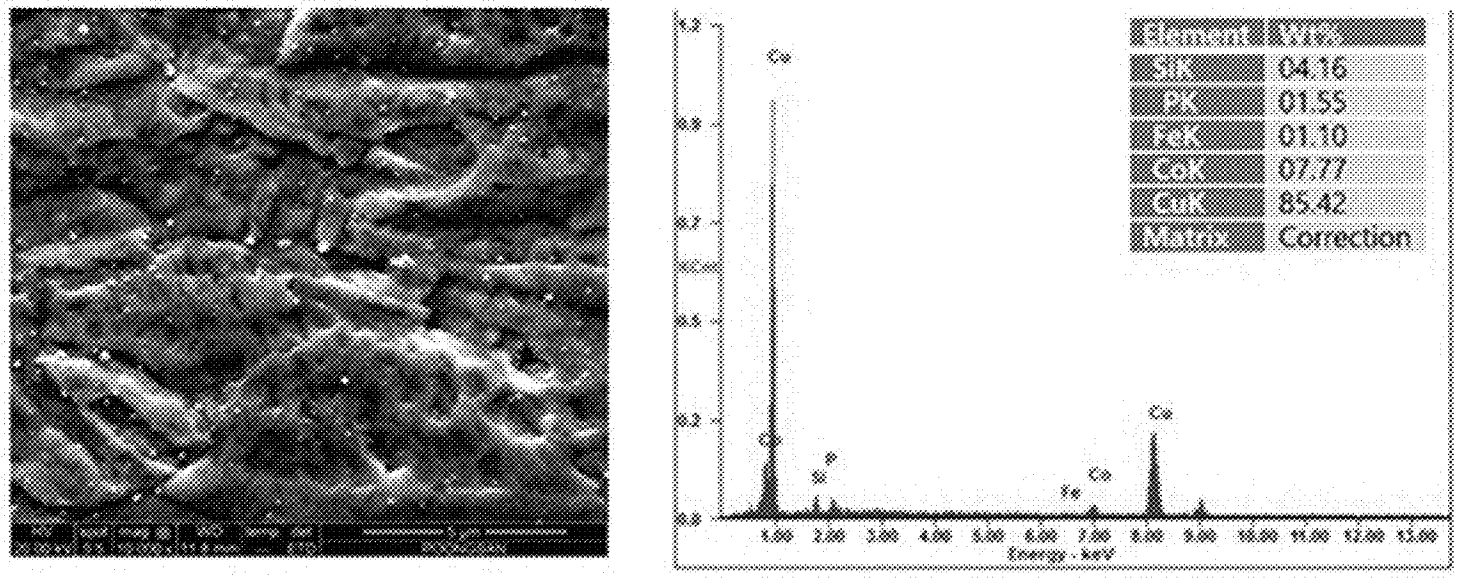

[FIG. 4]
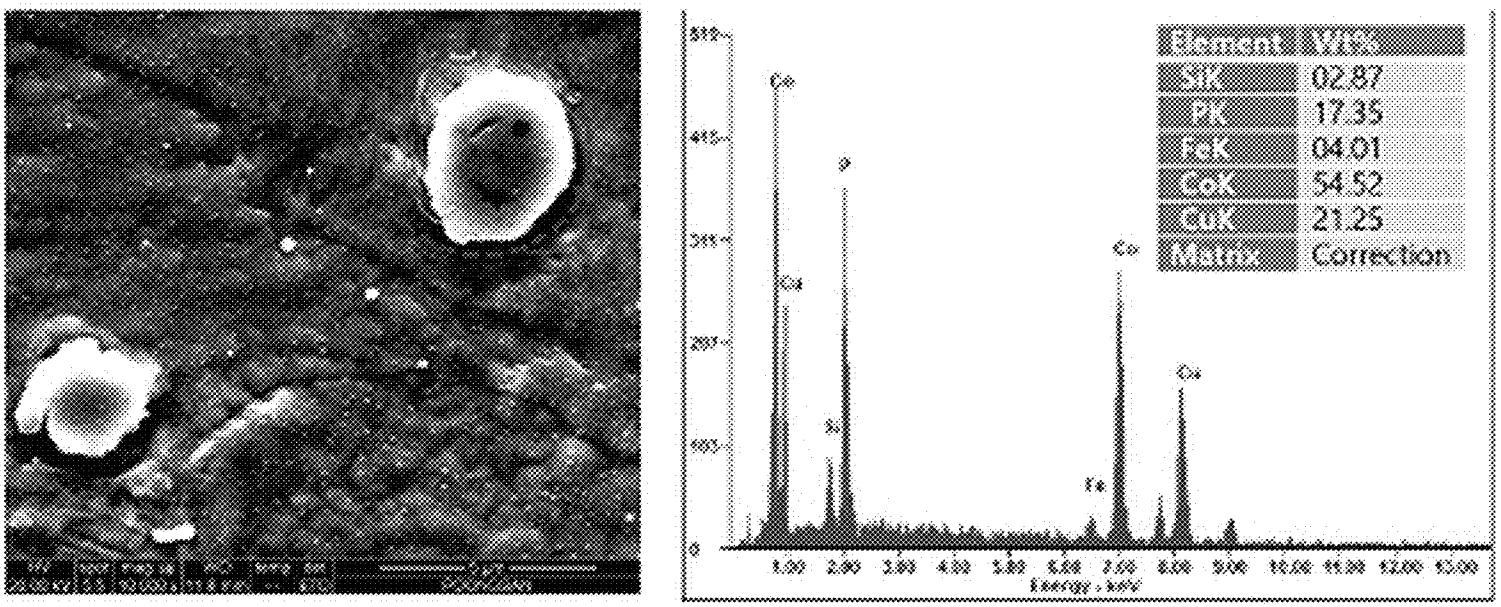

CU—CO—SI—FE—P-BASED ALLOY WITH EXCELLENT BENDING FORMABILITY AND PRODUCTION METHOD THEREOF

CROSS REFERENCE OF RELATED APPLICATIONS

The present application is a US national stage of a PCT international application, Serial no. PCT/KR2020/000941, filed on Jan. 20, 2020, which claims the priority of Korean patent application No. 10-2019-0041379, filed with KIPO of Republic of Korea on Apr. 9, 2019, the entire content of these applications are incorporated into the present application by reference herein.

TECHNICAL FIELD

The present disclosure relates to a copper-cobalt-silicon-iron-phosphorus (Cu—Co—Si—Fe—P)-based alloy having strength, electrical conductivity, and excellent bending formability, in which the alloy is composed of cobalt (Co) 1.2 to 2.5% by mass, silicon (Si) 0.2 to 1.0% by mass, iron (Fe) 0.01 to 0.5% by mass, phosphorus (P) 0.001 to 0.2% by mass, copper, and, unavoidable impurities, and the alloy has tensile strength of 650 MPa or higher, electrical conductivity of 65% IACS or higher, and high bending formability suitable for parts of small electronic equipment. Further, the present disclosure relates to a production method of the copper-cobalt-silicon-iron-phosphorus (Cu—Co—Si—Fe—P)-based alloy.

BACKGROUND ART

Recently, components of small electronic devices such as smartphones, tablet terminals, and digital cameras should be lighter than existing components, and at the same time, should have excellent performance characteristics that are equal to or higher than those of the existing components.

Conventionally, in the small electronic devices, phosphor bronze alloys having a strength of 590 MPa were used. However, recently, alloys of higher strength than 590 MPa are required for the electronic devices.

Further, the small-sized electronic devices must dissipate heat generated from parts during use thereof to prevent overheating of the parts (heat dissipation). Therefore, a copper alloy for a heat sink used for protecting a component from external impact should have strength as well as heat dissipation. The heat dissipation property of the copper alloy may be measured based on thermal conductivity. Electrical conductivity may be converted to the thermal conductivity based on Wiedemann-Franz's law. The thermal conductivity and the electrical conductivity may have a proportional relationship with each other in a specific temperature range. Thus, the thermal conductivity of the copper alloy may be calculated based on measurement of the electrical conductivity of the copper alloy.

Further, recently, a sheet for the small electronic device should have a thickness of 0.1 mm or smaller as the device is lighter, thinner, and smaller. However, since severe bending in a 180° bending degree such as HEM process (full contact bending) is performed at such a thickness, excellent bending formability is required even in the thin sheet state. When a crack occurs due to lack of bending formability during the process, the crack has an adverse effect on reliability of a product which in turn may not be applied to intended use.

Accordingly, a copper alloy sheet for an electronic part used in the electronic devices in recent years should have tensile strength of 600 MPa or greater, electrical conductivity of 50% IACS or greater, and bending formability at 90°. However, when using a general process of performing solution treatment once and then precipitation treatment, balance of strength and electrical conductivity may be maintained at 0.1 t or smaller, but it may be difficult to secure bending formability.

As a result, the copper alloy for the electronic part must satisfy not only high strength and high electrical conductivity, but also excellent bending formability.

Korean Patent Application No. 10-2011-7011427 discloses that due to addition of chromium (Cr), Cr preferentially precipitates on grain boundaries during hot working to suppress occurrence of cracks, thereby suppressing decrease in yield, and a Cr—Si-based compound may be produced to increase electrical conductivity and suppress coarsening of a grain size. However, Cr has high oxidizing property, thus, casting requires use of master alloy, thereby to increase a production cost, and to make difficult for adjusting the ratio of the components during the production at manufacturing sites. Further, as a Cr content increases, a production amount of the Cr—Si-based compound increases, such that strength of the alloy decreases due to lack of Si constituting $Co_2Si$. Further, a method of controlling a grain size to 15 to 30 μm via precipitation before the solution treatment is proposed in the above patent document. However, the precipitation heat treatment is one of the most expensive processes. When this proposed method is used, an entire process cost increases because the precipitation process is required two times.

Korean Patent Application No. 10-2012-7009703 relates to a Cu—Si—Co-based alloy for an electronic part, and a production method thereof. In this patent document, adjusting addition amounts of As, Sb, Be, B, Ti, Zr, Al and Fe may allow improving product characteristics such as strength, conductivity, stress relaxation characteristics, plating properties. The elements as added are formed a solid solution in a matrix and are contained in secondary phase particles or allow formation of secondary phase particles having a new composition, thereby to enhance target effects. However, when the elements are not precipitated and remain in the matrix, the strength increases, but the electrical conductivity decreases and thus the heat dissipation decreases. Therefore, in order to improve the strength and electrical conductivity at the same time, additional measures are needed to reduce an concentration of the corresponding elements in the matrix. Further, in a production process, a first aging treatment is followed by rolling, and then a second aging treatment is carried out. However, an overall process cost is increased because the precipitation process as the most expensive process should be performed at least twice.

Korean Patent Application No. 10-2015-7030854 discloses that, when, in a precipitation hardened copper alloy, a grain size is 3 μm or smaller, secondary phase particles such as cobalt silicide precipitated on grain boundaries increase, such that grain boundary precipitation that does not contribute to strength increases, thereby to obtain desired strength, but coarse grains deteriorate bending formability. Thus, the above patent document discloses that it is ideal that an average grain size is adjusted to 5 to 15 μm. Further, a distance between secondary phase particles is controlled via multi-stage aging. The multi-stage aging may reduce a process cost by half compared to execution of several precipitation processes. However, when the bending formability is secured only via this method, it is difficult to balance tensile strength of 650 MPa or higher and electrical conductivity of 65% IACS or higher as required for the heat sink for electronic components. Even in an embodiment of the document, when the strength is 650 MPa or greater, the electrical conductivity is lower than 65% IACS. When the electrical conductivity is 65% IACS or grater, the strength is lower than 650 MPa.

Therefore, it is necessary to design a copper alloy that may have improved bending formability and may have balanced tensile strength and electrical conductivity, and to design a production method thereof.

DISCLOSURE

Technical Problem

A purpose of the present disclosure is to provide a Cu—Co—Si—Fe—P-based alloy in which balance between strength and electrical conductivity of the alloy is maintained, while the alloy has excellent bending formability even in a thin sheet state of 0.06 to 0.1 mm to meet recent thinning demand from an industry, and to provide a production method thereof.

Technical Solutions

According to the present disclosure, a copper alloy for an electronic material contains 1.2 to 2.5% by mass of cobalt (Co); 0.2 to 1.0% by mass of silicon (Si); 0.01 to 0.5% by mass of iron (Fe); 0.001 to 0.2% by mass of phosphorus (P); a balance amount of copper (Cu); unavoidable impurities; and optionally, 0.05% by mass or smaller of each of at least one selected from a group consisting of nickel (Ni), manganese (Mn) and magnesium (Mg), wherein a sum of contents of cobalt (Co) and silicon (Si) meets a relationship: $1.4 \leq Co+Si \leq 3.5$, wherein a ratio between cobalt (Co) mass and silicon (Si) mass meets a relationship: $3.5 \leq Co/Si \leq 4.5$, wherein a ratio between iron (Fe) mass and phosphorus (P) mass meets a relationship: $1.0 < Fe/P$.

The copper alloy contains $Co_2Si$ and $Fe_2P$ as precipitates.

When a sheet made of the copper alloy is subjected to 180° full-contact bending in rolling vertical and horizontal directions while a ratio R/t between a bending radius R and a thickness of the sheet t is set to 0, the sheet is free of a crack.

The copper alloy has a bimodal structure in which fine grains, each size being smaller than 10 μm, and coarse grains, each size being 10 to 35 μm coexist in a mixed manner, wherein an area of the fine grains is 0.1% or greater of a total area copper alloy.

The copper alloy is embodied as a sheet material.

According to the present disclosure, a method for producing the copper alloy for an electronic material of the present disclosure as defined above includes: (a) melting and casting 1.2 to 2.5% by mass of cobalt (Co), 0.2 to 1.0% by mass of silicon (Si), 0.01 to 0.5% by mass of iron (Fe), 0.001 to 0.2% by mass of phosphorus (P), a balance amount of copper (Cu), and optionally, 0.05% by mass or smaller of each of at least one selected from a group consisting of nickel (Ni), manganese (Mn) and magnesium (Mg), thereby to obtain an ingot; (b) maintaining the ingot at 900 to 1100° C. for 30 minutes to 4 hours and then hot rolling the ingot to form a product; (c) performing a first cold rolling treatment of the product at a cold reduction rate of 90% or greater to form a sheet material; (d) performing an intermediate heat treatment of the sheet material at 400 to 800° C. for 5 to 500 seconds; (e) preforming a second cold rolling treatment of the sheet material at a cold reduction rate of 70% or smaller; (t) performing a solution treatment of the sheet material at 900 to 1100° C. for 5 to 500 seconds; (g) performing a third cold rolling treatment of the sheet material at a cold reduction rate of 10% or greater; (h) performing two-stages precipitation including: a first stage precipitation in which the sheet material is heated at 480 to 600° C. for 1 to 24 hours, and a second stage precipitation in which the sheet material is heated at 400 to 550° C. for 1 to 24 hours; (i) performing a final cold rolling treatment of the sheet material at a cold reduction rate of 5 to 70%; and (j) performing a stress removal treatment of the sheet material for 2 to 3000 seconds at 300 to 700° C.

In the two-stages precipitation (h), a difference between heating temperatures of the first and second stages is in a range of 40 to 120° C.

Advantageous Effects

The production method according to the present disclosure may produce a Cu—Co—Si—Fe—P-based alloy in which balance between strength and electrical conductivity of the alloy is maintained, while the alloy has excellent bending formability even in a thin sheet state of 0.06 to 0.1 mm.

DESCRIPTION OF DRAWINGS

FIG. 1 is an optical microscope image of a cross section of a bent portion when a sample of Example 2 at a thickness of 0.1 mm is subjected to 180° full-contact bending in a rolling width direction (B.W.).

FIG. 2 shows an optical microscope image of a cross section of a bent portion when a sample of Comparative Example 5 at a thickness of 0.1 mm is subjected to 180° full-contact bending in a rolling width direction (B.W.).

FIG. 3 is a scanning electron microscope and EDS based measurement result image of a sample according to Example 5 to identify a shape and a composition of a secondary phase formed when Fe and P are added.

FIG. 4 is a scanning electron microscope and EDS based measurement result image of a sample according to Comparative Example 7 to identify a shape and a composition of a secondary phase formed when Fe/P is smaller than 1.

BEST MODE

Hereinafter, the present disclosure will be described in more detail. However, a following description should be understood only as an exemplary embodiment for implementation of the present disclosure, and a scope of the present disclosure is defined by contents described in claims below.

Herein, a content of a component element is expressed as % by mass, unless otherwise indicated.

The present disclosure provides a Cu—Co—Si—Fe—P-based alloy containing: 1.2 to 2.5% by mass of cobalt (Co); 0.2 to 1.0% by mass of silicon (Si); 0.01 to 0.5% by mass of iron (Fe); 0.001 to 0.2% by mass of phosphorus (P); a balance amount of copper (Cu); unavoidable impurities; and optionally, 0.05% by mass or smaller of each of at least one selected from a group consisting of nickel (Ni), manganese (Mn) and magnesium (Mg), wherein a sum of contents of cobalt (Co) and silicon (Si) meets a relationship: $1.4 \leq Co+Si \leq 3.5$, wherein a ratio between cobalt (Co) mass and silicon (Si) mass meets a relationship: $3.5 \leq Co/Si \leq 4.5$, wherein a ratio between iron (Fe) mass and phosphorus (P) mass meets a relationship: $1.0 < Fe/P$. In the Cu—Co—Si—Fe—P-based alloy according to the present disclosure, due to mixture of fine grains and coarse grains and addition of iron (Fe) and phosphorus (P), coarsening of a $Co_2Si$ phase is suppressed and a fine $Fe_2P$ phase is dispersed to improve bending formability.

Specific meaning of the components of the copper alloy and the contents thereof according to the present disclosure is as follows.

(1) Cobalt (Co): 1.2 to 2.5% by Mass

In a matrix of the copper alloy in accordance with the present disclosure, Co and $Co_2Si$ act as a hard phase. Co has a solubility limit of 0.35% by mass at room temperature and $Co_2Si$ has a solubility limit of 0.3% by mass at 300° C. Since those values are lower than solubility of $Ni_2Si$, Co and $Co_2Si$ may form precipitates on a copper matrix more easily than $Ni_2Si$ may. Thus, the Cu—Co—Si—Fe—P-based alloy may have improved electrical conductivity at the same strength than a Cu—Ni—Si-based alloy. When Co is added at a content smaller than 1.2% by mass, the alloy may not have a strength of 650 MPa or greater. When Co is added at a content larger than 2.5% by mass, the alloy may not have electrical conductivity of 65% IACS.

(2) Silicon (Si): 0.2 to 1.0% by Mass

In the copper alloy according to the present disclosure, silicon (Si) together with cobalt (Co) forms a $Co_2Si$ precipitate to inhibit movement of dislocations to improve strength. When the precipitate is formed, an amount of an element in a form of solid solution in the copper matrix may decrease, thereby contributes to further improving electrical conductivity. When a Si content is smaller than 0.2% by mass, the effect of improving the electrical conductivity may not be sufficiently exhibited. When the Si content exceeds 1.0% by mass, Si may not form the precipitate, but Si remaining in the copper matrix decreases the electrical conductivity and adversely affects castability and cold rolling workability. Thus, the silicon (Si) content may be in a range of 0.2 to 1.0% by mass.

(3) Iron (Fe): 0.01 to 0.5% by Mass

In the copper alloy according to the present disclosure, iron (Fe) forms a $Fe_2P$ phase, thus causing a pinning effect during solution treatment, thus inhibiting coarsening of grains and contributing to strength improvement. In the copper alloy according to the present disclosure, a Fe content ranges from 0.01 to 0.5% by mass. When the Fe content is smaller than 0.01% by mass, the $Fe_2P$ phase may not be formed, and a fine grain required for a bimodal structure as described later may not be obtained. To the contrary, when the Fe content exceeds 0.5% by mass, an amount of precipitation of the $Fe_2P$ phase increases, a driving force of precipitation of $Co_2Si$ decreases, so that an amount of precipitation of $Co_2Si$ decreases.

(4) Phosphorus (P): 0.001 to 0.2% by Mass

In the copper alloy according to the present disclosure, phosphorus (P) forms a precipitated particle ($Fe_2P$ phase) of a Fe—P compound, thus to improve the strength of the copper alloy. Further, phosphorus (P) acts as a deoxidizer at a casting stage during a production process and inhibits growth of a grain during hot rolling or solution treatment. When the P content is smaller than 0.001% by mass, the $Fe_2P$ phase is not formed, and thus a grain refinement effect may not be obtained. When the P content exceeds 0.2% by mass, hot rolling causes side cracks, which deteriorate workability.

(5) Sum of Contents of Cobalt (Co) and Silicon (Si): 1.4 to 3.5% by Mass

In the copper alloy according to the present disclosure, cobalt (Co) and silicon (Si) are precipitated on the matrix via heat treatment during the process, thereby simultaneously improving electrical conductivity and strength. A sum of contents of cobalt (Co) and silicon (Si) is in a range of 1.4 to 3.5% by mass. When the sum exceeds the above range, electrical conductivity is lowered to be smaller than 65% IACS. When the sum is smaller than the above range, the strength is lowered, so that the alloy may not be used for a heat sink for an electronic component.

(6) Ratio Between Cobalt (Co) Mass and Silicon (Si) Mass: $3.5 \leq Co/Si \leq 4.5$ When a ratio Co/Si of the mass of Co with respect to the mass of Si is too low, an oxide film of $SiO_2$ is formed on a surface to degrade surface quality. When the ratio is too high, it is difficult to obtain high strength due to insufficient Si amount required for silicide formation. Thus, the ratio Co/Si in the alloy should be controlled to be in a range of $3.5 \leq Co/Si \leq 4.5$.

(7) Ratio Between Iron (Fe) Mass and Phosphorus (P) Mass: $1.0 < Fe/P$

When the ratio Fe/P of the mass of Fe to the mass of P is too low, coarse Co—P-based precipitate having a size of 2 μm or greater is formed, thereby reducing electrical conductivity and strength. Further, P that is not precipitated but remains on the matrix affects reduction of electrical conductivity.

When the relationship $1.0 < Fe/P$ is met, two-phase particles of $Co_2Si$ and $Fe_2P$ precipitated upon cooling in a hot rolling process serve to prevent recrystallization and growth of recrystallization in a solution treatment process. Thus, the relationship $1.0 < Fe/P$ should be met in order to form a bimodal structure that may achieve target strength, target electrical conductivity, and target bending formability of the alloy according to the present disclosure.

(8) Content of Nickel (Ni), Manganese (Mn), Magnesium (Mg): 0.05% by Mass or Smaller At least one of nickel (Ni), magnesium (Mg), and manganese (Mn) may be further added to the copper alloy for the electronic material according to the present disclosure. Each of the above component elements is formed a solid solution to improve the strength but to lower the electrical conductivity. Thus, a content thereof is limited to 0.05% by mass or smaller. That is, when adding each element at a trace amount of 0.05% by mass or smaller, the corresponding element does not significantly affect the reduction of electrical conductivity. The balance amount of the copper is reduced by the amount of the corresponding component element as added.

(9) Unavoidable Impurities

Unavoidable impurities are elements that are inevitably added to the alloy in the production process, such as zinc (Zn), tin (Sn), arsenic (As), antimony (Sb), cadmium (Cd), etc. When a sum of contents thereof is controlled to be smaller than 0.05% by mass, the properties of the copper alloy according to the present disclosure may not be significantly affected.

(10) Bimodal Structure

It is confirmed, from a result of observing a microstructure using an electron scanning microscope (FE-SEM) and EDS, that the copper alloy according the present disclosure has a bimodal structure in which grains of smaller than 10 μm (hereinafter, fine grains) and grains of 10 to 35 μm (hereinafter, coarse grains) are present in a mixed manner. In this connection, an area of the fine grains is 0.1% or greater of a total area. In the above bimodal structure, the fine grains serve to improve strength based on a Hall-perch equation, while the coarse grains serve to increase elongation to improve the formability.

In general, when the grain is coarse, an area of grain boundaries in the alloy is small and a stress is concentrated. Thus, the stress is concentrated on the grain boundary during bending, so that coarse wrinkles or cracks are likely to occur. However, in the bimodal structure, the fine and coarse grains exist together such that the area of the grain boundaries is larger than that when only the coarse grains exist. Thus, the concentration of the stress is lowered. Therefore, the bending formability of the copper alloy having the bimodal structure is improved.

Further, the copper alloy according to the present disclosure contains $Co_2Si$ and $Fe_2P$ based fine precipitates uniformly distributed within the copper matrix and having a size of 500 nm or smaller. In this connection, the precipitates formed on the grain boundaries do not contribute to the strength. Thus, when there are only fine grains, there are many precipitates deposited on the grain boundaries. This is disadvantageous in securing the strength. In the bimodal structure, coarse grains and fine grains are present in a mixed manner. In this connection, the precipitates deposited in the coarse grains contribute to strength. Thus, the strength of the copper alloy according to the present disclosure may be improved.

The copper alloy according to the present disclosure is embodied as a sheet material. In particular, the copper alloy according to the present disclosure may be formed into a thin sheet of a thickness of 0.1 mm or smaller for use in a part of a small electronic device. According to the present disclosure, the sheet material has excellent bending formability at a thickness of 0.06 mm to 0.1 mm. That is, in a sheet made of the copper alloy according to the present disclosure, a crack does not occur, when a ratio R/t between a bending radius R and a sheet thickness t is set to 0 and the sheet is subjected to 180° full-contact bending in rolling vertical and horizontal directions. For example, FIG. 1 is an optical microscope image of a cross section of a bent portion when a sample of Example 2 at a thickness of 0.1 mm is subjected to 180° full-contact bending in a rolling width direction (B.W.). FIG. 1 shows that no crack occurs.

Production Method of Cu—Co—Si—Fe—P Alloy According to the Present Disclosure

The Cu—Co—Si—Fe—P alloy according to the present disclosure may be produced using a following method.

According to the present disclosure, a method for producing the copper alloy as defined above includes: (a) melting and casting 1.2 to 2.5% by mass of cobalt (Co), 0.2 to 1.0% by mass of silicon (Si), 0.01 to 0.5% by mass of iron (Fe), 0.001 to 0.2% by mass of phosphorus (P), a balance amount of copper (Cu), and optionally, 0.05% by mass or smaller of each of at least one selected from a group consisting of nickel (Ni), manganese (Mn) and magnesium (Mg), thereby to obtain an ingot; (b) maintaining the ingot at 900 to 1100° C. for 30 minutes to 4 hours and then hot rolling the ingot to form a product; (c) performing a first cold rolling treatment of the product at a cold reduction rate of 90% or greater to form a sheet material; (d) performing an intermediate heat treatment of the sheet material at 400 to 800° C. for 5 to 500 seconds; (e) preforming a second cold rolling treatment of the sheet material at a cold reduction rate of 70% or smaller; (f) performing a solution treatment of the sheet material at 900 to 1100° C. for 5 to 500 seconds; (g) performing a third cold rolling treatment of the sheet material at a cold reduction rate of 10% or greater; (h) performing two-stages precipitation including: a first stage precipitation in which the sheet material is heated at 480 to 600° C. for 1 to 24 hours, and a second stage precipitation in which the sheet material is heated at 400 to 550° C. for 1 to 24 hours; (i) performing a final cold rolling treatment of the sheet material at a cold reduction rate of 5 to 70%; and (j) performing a stress removal treatment of the sheet material for 2 to 3000 seconds at 300 to 700° C.

Specifically, the production method of the copper alloy according to the present disclosure is as follows.

First, 1.2 to 2.5% by mass of cobalt (Co), 0.2 to 1.0% by mass of silicon (Si), 0.01 to 0.5% by mass of iron (Fe), 0.001 to 0.2% by mass of phosphorus (P), a balance amount of copper (Cu), and optionally, 0.05% by mass or smaller of each of at least one selected from a group consisting of nickel (Ni), manganese (Mn) and magnesium (Mg) are melt to obtain a molten metal having a desired composition, which is cast in an ingot form ((a) melting and casting step). At this stage, some unavoidable impurities may be added. The total content thereof is controlled to be 0.05% by mass or smaller.

The previously generated ingot is maintained at 900 to 1100° C. for 30 minutes to 4 hours and is subjected to a hot rolling treatment ((b) hot rolling step). When the hot rolling is performed after maintaining the ingot at a temperature of lower than 900° C. for a time duration smaller than 30 minutes, cobalt and nickel are not sufficiently formed a solid solution in the copper alloy matrix, and coarse $Co_2Si$ precipitates remain, thus causing cracks during hot rolling, thereby to deteriorate the formability. When hot rolling is performed after maintaining the ingot at a temperature of higher than 1100° C. and for a duration larger than 4 hours, the grains become coarse, which causes lowering the strength of a final product or increases risk of re-melting the ingot. At an end of the hot rolling process, the temperature is set to 900° C. or higher. Then, at an average cooling rate 10° C./s or greater, the temperature is lowered from 900° C. to 350° C. In this way, coarse Co precipitates may be prevented from remaining.

Subsequently, an intermediate product is subjected to the first cold rolling at a cold reduction rate of 90% or greater ((c) first cold rolling step). In this first cold rolling step, as the cold reduction rate increases, the number of deformation sites as precipitation sites increases. Thus, subsequently, uniform precipitation may occur.

Next, the intermediate heat treatment is performed at 400 to 800° C. for 5 to 500 seconds ((d) intermediate heat treatment step). At this stage, the product has a sub-annealed texture where a portion of the treated texture is annealed. In this connection, a recrystallization percentage is controlled to 50% or smaller. When the intermediate heat treatment is performed in the corresponding temperature range, the Fe2P phase and Co2Si phase generated during cooling in the hot rolling process may prevent recrystallization and grain growth. When the temperature is lower than 400° C. and the time duration is smaller than 5 seconds, recrystallization of a portion of the texture does not occur and the sub-annealed texture is not generated. When the temperature is above 800° C. and the time duration is larger than 500 seconds, it is difficult to control the recrystallization percentage to 50% or smaller, so that it is difficult to obtain a structure having different grains sizes from each other in a final step.

Subsequently, the cold rolling treatment is performed at the cold reduction rate of 70% or smaller ((e) second cold rolling step). When the solution treatment is performed after the intermediate heat treatment without the second cold rolling as described above, a non-uniform shear texture is not generated, and thus additional driving force for grain growth is insufficient, so that a fine texture having different grain sizes targeted by the present disclosure may not be obtained. When the cold reduction rate is larger than 70%, previously generated grains are not maintained, so that a fine texture having different grain sizes may not be obtained.

Next, the solution treatment is performed at 900 to 1100° C. for 5 to 500 seconds ((f) solution treatment step). In the solution treatment, Co, Si, Fe, etc. are formed a solid solution on the Cu matrix, and the grain is recrystallized to a constant size. When the solution treatment is performed at a temperature lower than 900° C. and for the duration smaller than 5 seconds, the desired electrical conductivity is not obtained in the final step because an element to be formed a solid solution is not sufficiently formed a solid solution on the matrix. When the solution treatment is performed at a temperature above 1100° C. and for a duration larger than 500 seconds, fine grains may not remain and all grains may grow to be coarse, thereby not to achieve the desired strength in the final step.

Then, the cold rolling is performed at a cold reduction rate of 10% or greater ((g) third cold rolling step). The number of sites for precipitate formation is increased via this cold rolling.

Thereafter, two-stages precipitation treatment is performed ((h) two-stages precipitation process). In a first stage, precipitated particles of $Co_2Si$ and $Fe_2P$ are formed. In a second stage, electrical conductivity may be increased by maximally growing the precipitated particles to an extent that contributes to strength, and, at the same time, the strength and electrical conductivity may be increased by depositing newly precipitated particles. The two-stages precipitation treatment is performed while the material is wound in a coil shape.

In the two-stages precipitation treatment, the temperature in a furnace is maintained at two ranges. In the first precipitation treatment, the temperature in a furnace is maintained at 480 to 600° C. for 1 to 24 hours (the first stage). In the second precipitation treatment, the temperature in a furnace is maintained at 400 to 550° C. for 1 to 24 hours (the second stage). When the temperature of the first stage is above 600° C. and the time duration thereof is larger than 24 hours, the precipitate is coarse and thus a desired strength is not obtained. When the temperature thereof is lower than 480° C. and the time duration thereof is smaller than 1 hour, the formation amount of precipitates is insufficient, so that the desired strength and electrical conductivity may not be obtained. When the temperature of the second stage exceeds 550° C. and the duration thereof exceeds 24 hours, the precipitate is coarsened and thus the desired strength is not obtained. When the temperature thereof is lower than 400° C. and the duration is smaller than 1 hour, it is difficult to obtain an effect of improving electrical conductivity and strength.

The difference between the temperatures of the two stages is in a range of 40 to 120° C. When the temperature difference is smaller than 40° C., the precipitate precipitated in the first stage is coarse, thus leading to a decrease in strength, when the temperature difference is greater than 120° C., the electrical conductivity may not be increased because the precipitate precipitated in the first-stage precipitation process hardly grows in the second-stage precipitation process. Further, it is difficult to form new precipitates in the second stage, such that the strength and electrical conductivity may not increase.

Between the 1st-stage precipitation step and the 2nd-stage precipitation step, the temperature in the furnace may be lowered at a rate of 0.1° C./min to 50° C./min. When the temperature is lowered at the rate of the above range, it is advantageous that the balance between the strength and electrical conductivity is improved. When the temperature drop rate is smaller than 0.1° C./min, the precipitates are coarse and thus the strength decreases. When the rate exceeds 50° C./min, it is difficult to control the temperature at the time of precipitation in the second stage, and thus it is difficult to improve the strength and electrical conductivity by additionally depositing fine precipitates in the second stage.

Subsequently, after the precipitation, a cold rolling is performed at a cold reduction rate of 5 to 70% to obtain a final thickness ((i) final cold rolling step). When the cold rolling is performed at a cold reduction rate of smaller than 5%, it is difficult to obtain a uniform sheet shape in a final product. When the cold rolling is performed at a cold reduction rate of greater than 70%, the bending formability in the final product deteriorates even when stress relief annealing is performed after the cold rolling.

The stress relief or removal annealing is performed at 300 to 700° C. for 2 to 3000 seconds ((j) stress relief annealing step). When the stress relief annealing is not performed, bending formability may deteriorate because stress inside the alloy causes non-uniform deformation.

Between the above steps, pickling and polishing may be performed to remove an oxide scale.

The Cu—Co—Si—Fe—P-based alloy according to the present disclosure is a precipitation hardened copper alloy, which contains Co2Si and Fe2P precipitates in the copper matrix. The alloy has a bimodal structure in which fine grains and coarse grains coexist in the mixed manner to improve the bending formability while maintaining the balance of strength and electrical conductivity. The combination of the simultaneous addition of Fe and P, and the intermediate heat treatment to control the recrystallization percentage to 50% or smaller, and the second cold rolling treatment process at the cold reduction rate of 70% or smaller, and the solution treatment may allow achieving the bimodal structure in which fine grains with a grain size of smaller than 10 μM are mixed with coarse grains with a grain size of 10 to 35 μm. The bimodal structure may improve the bending formability while maintaining the balance of strength and electrical conductivity.

According to the present disclosure, after forming the sub-annealed texture via the intermediate heat treatment, the second cold rolling and the solution treatment are carried out to form the bimodal structure in which fine grains with a grain size of smaller than 10 μm are mixed with coarse grains with a grain size of 10 to 35 μm. Then, a structure in which fine $Co_2Si$ and $Fe_2P$ precipitates are uniformly distributed is formed via the two-stages precipitation treatment. Then, the final cold rolling is executed at the cold reduction rate of 5 to 70%. In this way, the Cu—Co—Si—Fe—P alloy having the excellent bending formability while the balance between the strength and electrical conductivity is maintained may be produced.

The Cu—Co—Si—Fe—P-based alloy according to the present disclosure may be used for an electronic component heat sink, a connector, a relays, a switch, etc.

EXAMPLES

Hereinafter, Examples of the present disclosure are described together with Comparative Examples. These Examples are provided for the skilled person to the art to better understand the present disclosure and advantages thereof and are not intended to limit the present disclosure.

Examples 1 to 12

As described in Tables 1 to 3 and descriptions as set forth below, specimens according to Examples 1 to 12 were obtained. Each process condition according to each Example is shown in Table 2 and Table 3.

Co, Si, Fe, P, and Cu at contents indicate by Table 1 were melt at 1300° C. in a high frequency melting furnace. A resulting molten metal was cast into an ingot having a thickness of 30 mm ((a) melting and casting step).

The ingot was heated to 1000° C. for 1 hour, followed by hot rolling to a sheet thickness of 11 mm ((b) hot rolling step). The material temperature at the end of the hot rolling was 920° C. Thereafter, the hot-rolled product was cooled using water at the average cooling rate in a range of 10° C. is or greater in the temperature range of 900° C. to 350° C. in which precipitates are generated so that no Co-based coarse precipitates remained.

Subsequently, the first cold rolling was performed at a cold reduction rate of 94 to 95% ((c) first cold rolling step).

Subsequently, the intermediate heat treatment was performed at 780° C. and for a heating time duration of 60 seconds, followed by water cooling ((d) intermediate heat treatment step). At this time, the recrystallization percentage was 50% or smaller, and an average grain size of a grain in a recrystallized portion was a size of 1 μm or greater.

Subsequently, the second cold rolling was performed with a cold reduction rate of 70% ((e) second cold rolling).

Subsequently, the solution treatment was performed at 950° C. and for a heating time of 30 seconds, followed by water based cooling ((f) solution treatment step).

Subsequently, the third cold rolling was performed at a cold reduction rate of 6% ((g) third cold rolling step).

Subsequently, the two-stages precipitation treatment was performed under the conditions as described in Table 2 ((h) two-stages deposition treatment).

The final cold rolling was performed at a cold reduction rate of 33% (0.1 mm) and 60% (0.06 mm) ((i) final cold rolling step). Then, finally, the stress relief annealing was performed at 500° C. and for a heating time of 30 seconds to obtain each test sample ((j) stress relief treatment step), Between the above steps, appropriate polishing, pickling, and degreasing were performed.

Comparative Examples 1 to 31

As disclosed in Table 3, the specimens of Comparative Examples 1 to 31 were produced in the same manner as in the production method of Examples, except that 29 compositions shown in Table 1 and process conditions according to Table 2 were employed.

TABLE 1

| Examples | Alloy number | Alloy composition (mass %) | | | | | | | |
|---|---|---|---|---|---|---|---|---|---|
| | | Cu | Co | Si | Fe | Mg | Mn | Ni | P |
| Present Examples | 1 | Balance | 1.2 | 0.29 | 0.15 | — | — | — | 0.039 |
| | 2 | Balance | 1.6 | 0.38 | 0.15 | — | — | — | 0.039 |
| | 3 | Balance | 1.9 | 0.45 | 0.15 | — | — | — | 0.039 |
| | 4 | Balance | 1.2 | 0.29 | 0.15 | — | — | — | 0.1 |
| | 5 | Balance | 1.6 | 0.38 | 0.15 | — | — | — | 0.1 |
| | 6 | Balance | 1.9 | 0.45 | 0.15 | — | — | — | 0.1 |
| | 7 | Balance | 1.7 | 0.39 | 0.05 | — | — | — | 0.01 |
| | 8 | Balance | 1.6 | 0.38 | 0.25 | — | — | — | 0.07 |
| | 9 | Balance | 1.6 | 0.38 | 0.49 | — | — | — | 0.14 |
| | 10 | Balance | 1.6 | 0.38 | 0.15 | 0.009 | — | — | 0.039 |
| | 11 | Balance | 1.6 | 0.38 | 0.15 | — | 0.009 | — | 0.039 |
| | 12 | Balance | 1.6 | 0.38 | 0.15 | — | — | 0.009 | 0.039 |
| Comparative Examples | 13 | Balance | 0.7 | 0.17 | 0.15 | — | — | — | 0.039 |
| | 14 | Balance | 3 | 0.71 | 0.15 | — | — | — | 0.039 |
| | 15 | Balance | 4 | 0.95 | 0.15 | — | — | — | 0.039 |
| | 16 | Balance | 1.6 | 0.38 | — | — | — | — | — |
| | 17 | Balance | 1.9 | 0.45 | — | — | — | — | — |
| | 18 | Balance | 1.6 | 0.38 | 0.005 | — | — | — | 0.001 |
| | 19 | Balance | 1.6 | 0.38 | 0.15 | — | — | — | 0.17 |
| | 20 | Balance | 1.6 | 0.38 | 0.25 | — | — | — | 0.32 |
| | 21 | Balance | 1.6 | 0.38 | 1.5 | — | — | — | 0.4 |
| | 22 | Balance | 1.6 | 0.38 | 0.15 | 0.1 | — | — | 0.039 |
| | 23 | Balance | 1.6 | 0.38 | 0.15 | — | 0.1 | — | 0.039 |
| | 24 | Balance | 1.6 | 0.38 | 0.15 | — | — | 0.1 | 0.039 |
| | 25 | Balance | 1.6 | 0.38 | 0.02 | — | — | — | — |
| | 26 | Balance | 1.6 | 0.38 | 0.4 | — | — | — | — |
| | 27 | Balance | 1.6 | 0.38 | — | — | — | — | 0.01 |
| | 28 | Balance | 1.6 | 0.38 | — | — | — | — | 0.15 |
| | 29 | Balance | 1.6 | 1.5 | 0.15 | — | — | — | 0.039 |

TABLE 2

| Examples | Intermediate heat treatment | | Second cold reduction | Solution treatment | | First precipitation stage condition | | Second precipitation stage condition | |
|---|---|---|---|---|---|---|---|---|---|
| | Temperature (° C.) | Time (s) | rate % | Temperature (° C.) | Time (s) | Temperature (° C.) | Time (hr) | Temperature (° C.) | Time (hr) |
| A | 780 | 60 | 70 | 950 | 30 | 530 | 3 | 460 | 2 |
| B | 350 | 60 | 70 | 950 | 38 | 530 | 3 | 460 | 2 |
| C | 950 | 60 | 70 | 950 | 30 | 530 | 3 | 460 | 2 |

TABLE 2-continued

| Examples | Intermediate heat treatment Temperature (° C.) | Intermediate heat treatment Time (s) | Second cold reduction rate % | Solution treatment Temperature (° C.) | Solution treatment Time (s) | First precipitation stage condition Temperature (° C.) | First precipitation stage condition Time (hr) | Second precipitation stage condition Temperature (° C.) | Second precipitation stage condition Time (hr) |
|---|---|---|---|---|---|---|---|---|---|
| D | 780 | 60 | 0 | 950 | 30 | 530 | 3 | 460 | 2 |
| E | 780 | 60 | 80 | 950 | 30 | 530 | 3 | 460 | 2 |
| F | 780 | 60 | 70 | 870 | 5 | 530 | 3 | 460 | 2 |
| G | 780 | 60 | 70 | 950 | 600 | 530 | 3 | 460 | 2 |
| H | 780 | 60 | 70 | 950 | 30 | 620 | 3 | 460 | 2 |
| I | 780 | 60 | 70 | 950 | 30 | 530 | 30 | 460 | 2 |
| J | 780 | 60 | 70 | 950 | 30 | 530 | 3 | — | — |
| K | 780 | 60 | 70 | 950 | 30 | 460 | 3 | — | — |
| L | 780 | 60 | 70 | 950 | 30 | 530 | 3 | 320 | 2 |
| M | 780 | 60 | 70 | 950 | 30 | 530 | 3 | 460 | 0.5 |
| N | 780 | 60 | 70 | 950 | 30 | 530 | 3 | 510 | 2 |
| O | 780 | 60 | 70 | 950 | 30 | 550 | 3 | 400 | 2 |

Various characteristics of the specimens of Examples and Comparative Examples thus obtained were evaluated. The characteristic evaluation as performed is as follows.

(1) Tensile Strength

A tensile test piece in a direction parallel to a rolling direction was produced and measured according to KS B 0801. Table 3 shows the results.

(2) Electrical Conductivity (E.C)

KS D 0240 non-iron metal electrical conductivity measurement was applied. The measurement of E.C of a sheet-like material was performed using double bridge type equipment that had been calibrated based on a test temperature. Table 2 shows the results.

(3) Bending Formability: 180° Bendability Test

A 0.1 mm thick sample cut into a width of 100 mm and a length of 200 mm was used as a test piece for bending formability measurement. After bending the piece by about 170° at a predetermined bending radius R in a B.W, the piece at the twice of the bending inner radius R was pressed and bent at 180° to conduct a 180° bending test. A minimum bending radius (MBR) in which no crack was generated in a bent portion was divided by a sheet thickness, thereby to obtain MBR/t. The results are shown in Table 2 and FIG. 1 and FIG. 2. FIG. 1 and FIG. 2 are scanning electron microscope (SEM) analysis images of the specimens. FIG. 1 is an optical microscope image of a cross section of a bent portion when a sample of Example 2 at a thickness of 0.1 mm is subjected to 180° full-contact bending in a rolling width direction (B.W.). FIG. 2 shows an optical microscope image of a cross section of a bent portion when a sample of Comparative Example 5 at a thickness of 0.1 mm is subjected to 180° full-contact bending in a rolling width direction (B.W.). In FIG. 1, the cracks did not occur in the bent section under the above conditions, whereas in FIG. 2 the cracks occurred in the bent section.

(4) Observation

Grain sizes and area percentages of fine grains of the obtained specimens were identified using an optical microscope and a scanning electron microscope. The results are shown in Table 3 below and FIG. 3 and FIG. 4. Specifically, FIG. 3 is a scanning electron microscope and EDS based measurement result image of a sample according to Example 5 to identify a shape and a composition of a secondary phase formed when Fe and P are added. FIG. 4 is a scanning electron microscope and EDS based measurement result image of a sample according to Comparative Example 7 to identify a shape and a composition of a secondary phase formed when Fe/P is smaller than 1. The sample according to Example 5 in FIG. 3 has a secondary phase formed due to the addition of Fe and P, while in the sample according to Comparative Example 7 in FIG. 4, coarse precipitates of Co—P with a size of 2 to 4 μm and fine $Co_2Si$ precipitates are formed at the same time.

TABLE 3

| Examples | Alloy-composition number (Table 1) | Process | Average grain size (μm) fine grain | Average grain size (μm) coarse grain | Area percent of fine grain (%) | Tensile strength (MPa) | Electrical conductivity (% IACS) | 180° bending formability (B.W) of sheet 0.1 mm | 180° bending formability (B.W) of sheet 0.06 mm |
|---|---|---|---|---|---|---|---|---|---|
| Example 1 | 1 | A | 2 | 13 | 0.5 | 658 | 66 | 0 | 0 |
| Example 2 | 2 | | 2 | 14 | 1.5 | 662 | 65 | 0 | 0 |
| Example 3 | 3 | | 3 | 14 | 1.0 | 680 | 66 | 0 | 0 |
| Example 4 | 4 | | 3 | 13 | 1.5 | 660 | 65 | 0 | 0 |
| Example 5 | 5 | | 2 | 13 | 1.5 | 662 | 65 | 0 | 0 |
| Example 6 | 6 | | 2 | 13 | 1.0 | 663 | 65 | 0 | 0 |
| Example 7 | 7 | | 3 | 14 | 1.0 | 665 | 65 | 0 | 0 |
| Example 8 | 8 | | 2 | 12 | 1.5 | 663 | 65 | 0 | 0 |
| Example 9 | 9 | | 2 | 12 | 1.5 | 665 | 65 | 0 | 0 |
| Example 10 | 10 | | 3 | 14 | 1.0 | 665 | 65 | 0 | 0 |
| Example 11 | 11 | | 3 | 12 | 0.5 | 660 | 65 | 0 | 0 |
| Example 12 | 12 | | 2 | 14 | 0.5 | 661 | 65 | 0 | 0 |
| Comparative Example 1 | 13 | | 3 | 13 | 0.5 | 594 | 62 | 0.5 | 0.5 |
| Comparative Example 2 | 14 | | 2 | 12 | 1.0 | 778 | 56 | 0.5 | 0.5 |

TABLE 3-continued

| Examples | Alloy-composition number (Table 1) | Process | Average grain size (μm) fine grain | Average grain size (μm) coarse grain | Area percent of fine grain (%) | Tensile strength (MPa) | Electrical conductivity (% IACS) | 180° bending formability (B.W) of sheet 0.1 mm | 180° bending formability (B.W) of sheet 0.06 mm |
|---|---|---|---|---|---|---|---|---|---|
| Comparative Example 3 | 15 | | 2 | 12 | 1.0 | 901 | 51 | 0.5 | 0.5 |
| Comparative Example 4 | 16 | | — | 18 | — | 660 | 66 | 0.5 | 0.5 |
| Comparative Example 5 | 17 | | — | 17 | — | 663 | 65 | 0.5 | 0.5 |
| Comparative Example 6 | 18 | | 2 | 15 | — | 612 | 53 | 2.0 | 2.0 |
| Comparative Example 7 | 19 | | 3 | 14 | 1.0 | 676 | 59 | 1.5 | 1.5 |
| Comparative Example 8 | 20 | | 3 | 16 | 1.0 | 668 | 61 | 1.0 | 1.0 |
| Comparative Example 9 | 21 | | 2 | 12 | 1.0 | 672 | 62 | 1.0 | 1.0 |
| Comparative Example 10 | 22 | | 2 | 13 | 1.0 | 678 | 57 | 1.5 | 1.5 |
| Comparative Example 11 | 23 | | 2 | 15 | 1.0 | 667 | 59 | 1.0 | 1.0 |
| Comparative Example 12 | 24 | | 3 | 16 | 0.5 | 674 | 60 | 1.0 | 1.0 |
| Comparative Example 13 | 25 | | 3 | 12 | 1.0 | 659 | 65 | 0.5 | 0.5 |
| Comparative Example 14 | 26 | | 2 | 14 | 1.0 | 650 | 56 | 1.5 | 1.5 |
| Comparative Example 15 | 27 | | 2 | 14 | 1.5 | 660 | 64 | 1.0 | 1.0 |
| Comparative Example 16 | 28 | | 2 | 13 | 1.5 | 649 | 55 | Crack | |
| Comparative Example 17 | 29 | | Physical properties may not be measured due to occurrence of crack in hot rolling | | | | | | |
| Comparative Example 18 | 2 | B | — | 15 | 0 | 654 | 61 | 1.0 | 1.0 |
| Comparative Example 19 | 2 | C | — | 19 | 0 | 654 | 65 | 1.0 | 1.0 |
| Comparative Example 20 | 2 | D | — | 10 | 0 | 652 | 66 | 1.5 | 1.5 |
| Comparative Example 21 | 2 | E | — | 10 | 0 | 653 | 66 | 1.5 | 1.5 |
| Comparative Example 22 | 2 | F | — | 11 | 0 | 589 | 54 | 1.5 | 1.5 |
| Comparative Example 23 | 2 | G | — | 32 | 0 | 620 | 63 | 0.5 | 0.5 |
| Comparative Example 24 | 2 | H | 2 | 15 | 0.5 | 609 | 67 | 1.0 | 1.0 |
| Comparative Example 25 | 2 | I | 2 | 12 | 0.5 | 615 | 66 | 1.0 | 1.0 |
| Comparative Example 26 | 2 | J | 2 | 14 | 1.0 | 608 | 58 | 0.5 | 0.5 |
| Comparative Example 27 | 2 | K | 2 | 5 | 1.0 | 673 | 55 | 1.0 | 1.0 |
| Comparative Example 28 | 2 | L | 2 | 13 | 1.0 | 664 | 57 | 1.0 | 1.0 |
| Comparative Example 29 | 2 | M | 2 | 12 | 1.0 | 665 | 56 | 1.0 | 1.0 |
| Comparative Example 30 | 2 | N | 3 | 14 | 0.5 | 610 | 67 | 1.0 | 1.0 |
| Comparative Example 31 | 2 | O | 3 | 16 | 1.0 | 633 | 62 | 1.0 | 1.0 |

Examples 1 to 12 refer to copper alloys for the electronic material that satisfy the requirements as set forth in the present disclosure, and have high strength, high electrical conductivity, and excellent bending formability in a thin sheet such that the alloy may be used for a heat sink for the electronic device. It may be identified, based on Comparative Example 1, when the sum of the contents of Co and Si is 1.4 mass % or smaller, the strength decreases. It may be identified, based on Comparative Examples 2 and 3, when the sum of the contents of Co and Si is 3.5 mass % or greater, electrical conductivity is deteriorated.

It may be identified, based on Comparative Examples 4 and 5, that the target bending formability is not secured when Fe and P are not added. It may be identified, based on Comparative Examples 13 to 16, that when only Fe or P is added, the hot rolling property, electrical conductivity and bending formability were deteriorated.

It may be identified, based on Comparative Example 6, that even when Fe and P are simultaneously added but the amount of addition thereof is insufficient, the bending formability is not improved due to absence of the fine grains and thus non-formation of the bimodal structure in the solution treatment, and Fe and P remaining in the matrix adversely affect electrical conductivity. It may be identified from Comparative Examples 7 and 8 that when the Fe/P ratio is 1 or smaller, the Co—P-based precipitates of 2 μm or greater are formed, and thus, the electrical conductivity is reduced due to the excessively coarse precipitates. This may be identified in FIG. 4.

It may be identified, based on Comparative Example 9, that when Fe/P is greater than 1 but an Fe is added in an excessive amount, the electrical conductivity decreases.

It may be identified, based on Comparative Examples 10 to 12, that when each of Mg, Mn, Ni, etc., is added at 0.05% or smaller content, the final properties of the alloy are not significantly affected, whereas when at least one of Mg, Mn, Ni, etc. is added at a total content of 0.05% or greater, the electrical conductivity was degraded. It was not observed that the corresponding element was added to $Co_2Si$ in the corresponding composition, or that the element was coupled to silicon to form silicide.

It may be identified, based on Comparative Examples 13 to 14, that when only Fe was added, the electrical conductivity is somewhat reduced, and a fine grain is not formed and the bending formability is poor.

It may be identified, based on Comparative Examples 15 to 16, that when only P was added, the electrical conductivity is greatly reduced, and that as the P content increases, the side crack is severe and the bending formability is deteriorated.

It may be identified from Comparative Example 17 that when the silicon content exceeds 1.0%, a side crack occurs in the hot rolling step and a finished product may not be produced.

It may be identified from Comparative Example 18, that when the intermediate heat treatment temperature was low, the sub-annealed texture was not formed, and thus, the bimodal structure in which fine grains of smaller than 10 μm and coarse grains of 10 to 35 μm were mixed with each other was not formed after the solution treatment, and the bending formability in a 0.1 mm thin sheet is not improved. Comparative Example 19 shows that even when the intermediate heat treatment temperature is high, the bimodal structure is not generated and the bending formability is not improved. It may be identified from Comparative Example 20 that the bimodal structure is not created even when the cold rolling is not performed at the cold reduction rate smaller than 70% between the intermediate heat treatment and the solution treatment. It may be identified from Comparative Example 21 that the bimodal structure is not generated even when the cold reduction rate is 70% or greater, such that the formability is not improved. It may be identified from Comparative Example 22 that when the solution treatment temperature was too low, Co, Si, Fe, etc. are not sufficiently formed a solid solution into the matrix, resulting in insufficient formation of the precipitates in the final product, thereby resulting in decrease in the electrical conductivity and strength. It may be identified from Comparative Example 23 that when the solution treatment time is too large, the grain may be coarse and thus the strength may decrease, and the bimodal structure is not formed, such that the bending formability is significantly reduced.

It may be identified from Comparative Example 24 that when the temperature of the first-stage precipitation was high, the precipitate was coarsened and the strength was decreased. It may be identified from Comparative Example 25 that when the time of the first stage precipitation was large, the precipitate was coarsened and the strength was decreased. It may be identified from Comparative Examples 26 and 27 that when the two-stages precipitation is not performed, the alloy having electrical conductivity of 60% IAS or higher may not be obtained. It may be identified from Comparative Example 28 that when the temperature of the second stage precipitation is low, the element precipitated in the first stage does not grow, and the amount of additional precipitates is insufficient, such that improvement in electrical conductivity and strength may not be achieved. It may be identified from Comparative Example 29 that when the time of the second-stage precipitation was small, the desired strength and electrical conductivity may not be obtained due to insufficient growth of the element precipitated in the first stage, and insufficient amount of additional precipitates.

It may be identified based on Comparative Example 30 that the desired strength may not be obtained due to coarse precipitates because the difference between the temperatures of the first and second precipitation stages is too small. It may be identified based on Comparative Example 31 that when the difference between the temperatures of the first and second precipitation stages is too large, the target electrical conductivity and strength may not be obtained due to insufficient growth of the precipitates, and insufficient amount of additional precipitates.

What is claimed is:

1. A copper alloy for an electronic material, the alloy consisting of:

1.2 to 2.5% by mass of cobalt (Co);

0.2 to 1.0% by mass of silicon (Si);

0.01 to 0.5% by mass of iron (Fe);

0.001 to 0.2% by mass of phosphorus (P);

a balance amount of copper (Cu);

smaller than 0.05% by mass of a sum of unavoidable impurities;

optionally, 0.05% by mass or smaller of each of at least one selected from a group consisting of nickel (Ni), manganese (Mn) and magnesium (Mg);

wherein the unavoidable impurities are selected one or more from the group consisting of tin (Sn), arsenic (As), antimony (Sb), and cadmium (Cd);

wherein a sum of contents of cobalt (Co) and silicon (Si) meets a relationship: $1.4 \leq Co+Si \leq 3.5$;

wherein a ratio between cobalt (Co) mass and silicon (Si) mass meets a relationship: $3.5 \leq Co/Si \leq 4.5$;

wherein a ratio between iron (Fe) mass and phosphorus (P) mass meets a relationship: $1.0 < Fe/P$;

wherein the copper alloy contains $Co_2Si$ and $Fe_2P$ as precipitates;

wherein the copper alloy is embodied as a sheet material, wherein when the sheet material is subjected to 180° full-contact bending in rolling vertical and horizontal directions while a ratio R/t between a bending radius R and a thickness of the sheet is set to 0, the sheet is free of a crack; and wherein the copper alloy has a bimodal structure of copper alloy crystal grains having fine grains and coarse grains, wherein each of the fine grains comprises a size smaller than 10 μm, and wherein each of the coarse grains comprises a size of 10 to 35 μm, wherein the fine grains and the coarse grains coexist in a mixed manner, wherein an area of the fine grains is 0.1% or greater of a total area copper alloy.

2. A method for producing a copper alloy for an electronic material consisting of:

(a) melting and casting 1.2 to 2.5% by mass of cobalt (Co), 0.2 to 1.0% by mass of silicon (Si), 0.01 to 0.5% by mass of iron (Fe), 0.001 to 0.2% by mass of phosphorus (P), a balance amount of copper (Cu), smaller than 0.05% by mass of a sum of unavoidable impurities, and optionally, 0.05% by mass or smaller of each of at least one selected from a group consisting of nickel (Ni), manganese (Mn) and magnesium (Mg), thereby to obtain an ingot, wherein the unavoidable impurities are selected one or more from the group consisting of tin (Sn), arsenic (As), antimony (Sb), and cadmium (Cd);

(b) maintaining the ingot at 900 to 1100° C. for 30 minutes to 4 hours and then hot rolling the ingot to form a product;

(c) performing a first cold rolling treatment of the product at a cold reduction rate of 90% or greater to form a sheet material;

(d) performing an intermediate heat treatment of the sheet material at 400 to 800° C. for 5 to 500 seconds;

(e) preforming a second cold rolling treatment of the sheet material at a cold reduction rate of 70% or smaller;

(f) performing a solution treatment of the sheet material at 900 to 1100° C. for 5 to 500 seconds;

(g) performing a third cold rolling treatment of the sheet material at a cold reduction rate of 10% or greater;

(h) performing two-stages precipitation including: a first stage precipitation in which the sheet material is heated at 480 to 600° C. for 1 to 24 hours, and a second stage precipitation in which the sheet material is heated at 400 to 550° C. for 1 to 24 hours;

(i) performing a final cold rolling treatment of the sheet material at a cold reduction rate of 5 to 70%; and (j) performing a stress removal treatment of the sheet material for 2 to 3000 seconds at 300 to 700° C.

3. The method of claim 2, wherein in the two-stages precipitation (h), a difference between heating temperatures of the first and second stages is in a range of 40 to 120° C.

* * * * *